US007484383B1

(12) United States Patent
Turner

(10) Patent No.: US 7,484,383 B1
(45) Date of Patent: Feb. 3, 2009

(54) COOLING PITCHER

(76) Inventor: James Turner, P.O. Box 48506, St. Petersburg, FL (US) 33743

( * ) Notice: Subject to any disclaimer, the term of this patent is extended or adjusted under 35 U.S.C. 154(b) by 233 days.

(21) Appl. No.: 11/378,692

(22) Filed: Mar. 20, 2006

Related U.S. Application Data

(60) Provisional application No. 60/755,005, filed on Dec. 30, 2005.

(51) Int. Cl.
*F25D 3/08* (2006.01)

(52) U.S. Cl. ..... 62/457.3; 62/457.2; 62/530

(58) Field of Classification Search ..... 62/457.3, 62/457.2, 457.4, 530
See application file for complete search history.

(56) References Cited

U.S. PATENT DOCUMENTS 3,603,106 A * 9/1971 Ryan et al. ..... 62/457.4
3,715,895 A * 2/1973 Devlin ..... 62/457.3
3,766,975 A * 10/1973 Todd ..... 165/74
4,357,809 A 11/1982 Held et al.
5,189,892 A 3/1993 Roberts
5,299,433 A 4/1994 Harms et al.
5,970,737 A 10/1999 Downey

* cited by examiner

*Primary Examiner*—Melvin Jones
(74) *Attorney, Agent, or Firm*—Thomas Frost

(57) ABSTRACT

A pitcher for keeping beverages cooled for protracted periods, having a pitcher lining and a pitcher wall sealingly attached to form a cavity there between. A freezable substance is disposed within the cavity. The cavity extends continuously between the bottom walls of the pitcher lining and the pitcher wall allowing for complete cooling through the floor area of the pitcher. In an alternate embodiment an insulating layer is provided between the freezable substance and the inner surface of the sidewalls and bottom wall of the pitcher shell. The insulating layer further retards warming and reduces condensation.

5 Claims, 4 Drawing Sheets

COOLING PITCHER

CROSS-REFERENCE TO RELATED APPLICATION

This application claims the benefit of U.S. Provisional Application No. 60/755,005, filed Dec. 30, 2005.

FIELD OF THE INVENTION

The present invention relates to a beverage pitcher having a freezable non-toxic material injected within a cavity formed by sidewalls and bottom wall of the pitcher for cooling and maintaining liquid below 32 degrees Fahrenheit for an extended period.

BACKGROUND OF INVENTION

Using freezable materials to cool beverages within a pitcher is well known in the prior art as shown in U.S. Pat. Nos. 4,357,809; 5,189,892; and 5,299,433. While U.S. Pat. No. 5,970,737 describes a double wall configuration holding gel materials, the present invention provides an improvement in that the freezable materials are encapsulated in a double wall throughout the pitcher, including the floor area. Thus the complete area of the inner surface of the pitcher is used without resorting to additional attachments containing the freezable material. The use of a standard size pitcher, without other inner attachments for cooling the liquid, allows for easy storage in restaurants and bars.

SUMMARY OF THE INVENTION

The general purpose of the present invention, which will be described subsequently in greater detail, is to provide a new and improved cooling pitcher for beer or other liquids.

To attain this, the present invention comprises a standard plastic pitcher having a pitcher shell and a pitcher lining wherein a cooling gel is inserted between the shell and lining during the manufacturing process. The cooling gel is freezable and will allow the liquid substances in the pitcher to remain in a chilled state for a number of hours.

The sidewalls and bottom walls of the pitcher shell and pitcher lining are contiguously integrally formed with a space between. During the manufacturing process cooling gel is inserted in the space forming a cavity between the surfaces. The cooling gel is preferably the substance commonly known as "blue ice," although other suitable freezable materials are possible.

An alternative embodiment has an insulating layer, preferably foam, added within the cavity between the pitcher lining and the pitcher shell, and positioned between the freezable substance and inner surface of the pitcher shell. The added insulating layer will retard warming, and prevent condensation on the pitcher. A standard base is integrally formed with the pitcher shell, as is a standard handle.

Although pitchers with freezable material for cooling purposes, and specific structural configurations and designs, are well known in the prior art, there exists a need for a pitcher having cooling gel disposed within the pitcher walls, and configured to consistently cool the entire volume of the liquid encapsulated within the pitcher, including the bottom wall area.

Other pitchers require adding crushed ice in plastic bags or the like, and placing the ice within the liquid for cooling, or if freezable gel material is used require storage means for cooling within the inner area of the pitcher. Thus, the amount of volume that the pitcher can hold is decreased. The present invention allows consistent, and extended cooling, without losing any liquid volume.

It is an object of the present invention to provide for maximum space and maximum cooling of contents within a standard beer pitcher by having freezable gel material disposed within the cavity between the pitcher lining and the pitcher shell, including the space between the bottom walls of the pitcher lining and the pitcher shell.

It is another object of the present invention to have the pitchers constructed with the cooling material so that the pitchers can be easily stacked within freezer compartments of bars and restaurants.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Throughout the following detailed description, the same reference numbers refer to the same element in all figures.

Figure 1:
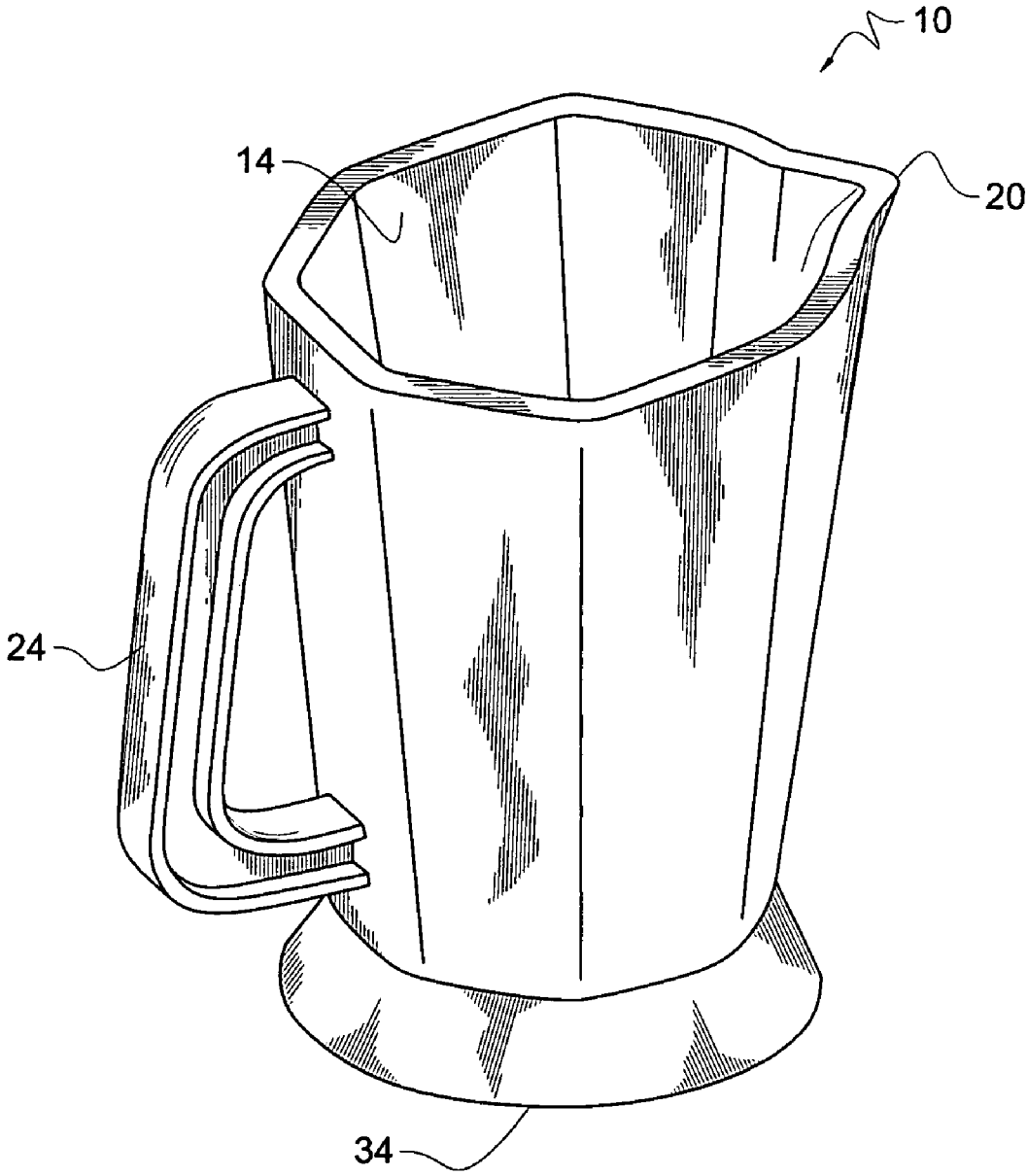
FIG. 1 is a perspective view of the present invention.
Figure 2:
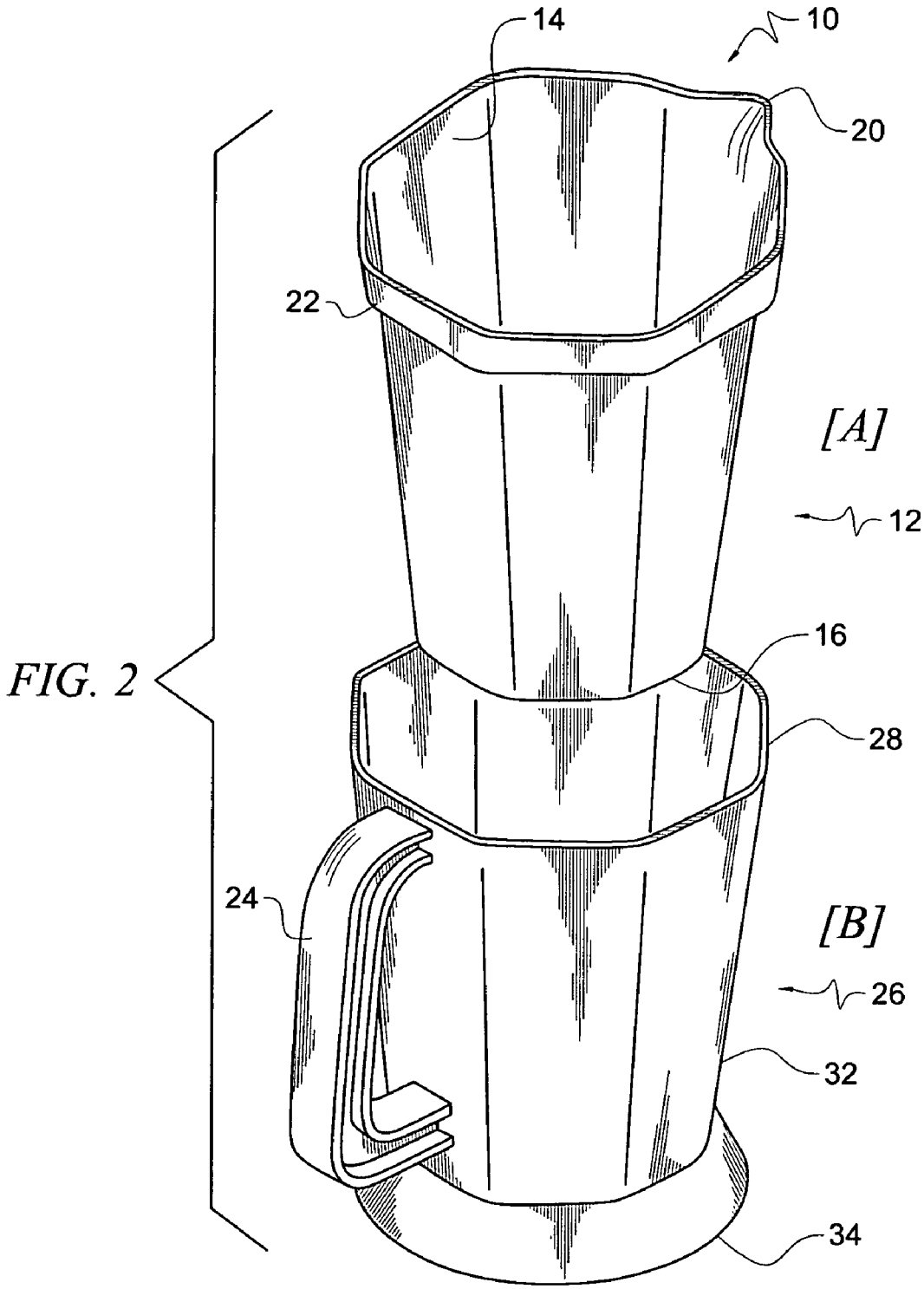
FIG. 2 is a perspective, exploded view showing at A the pitcher lining and at B the pitcher shell.
Figure 3:
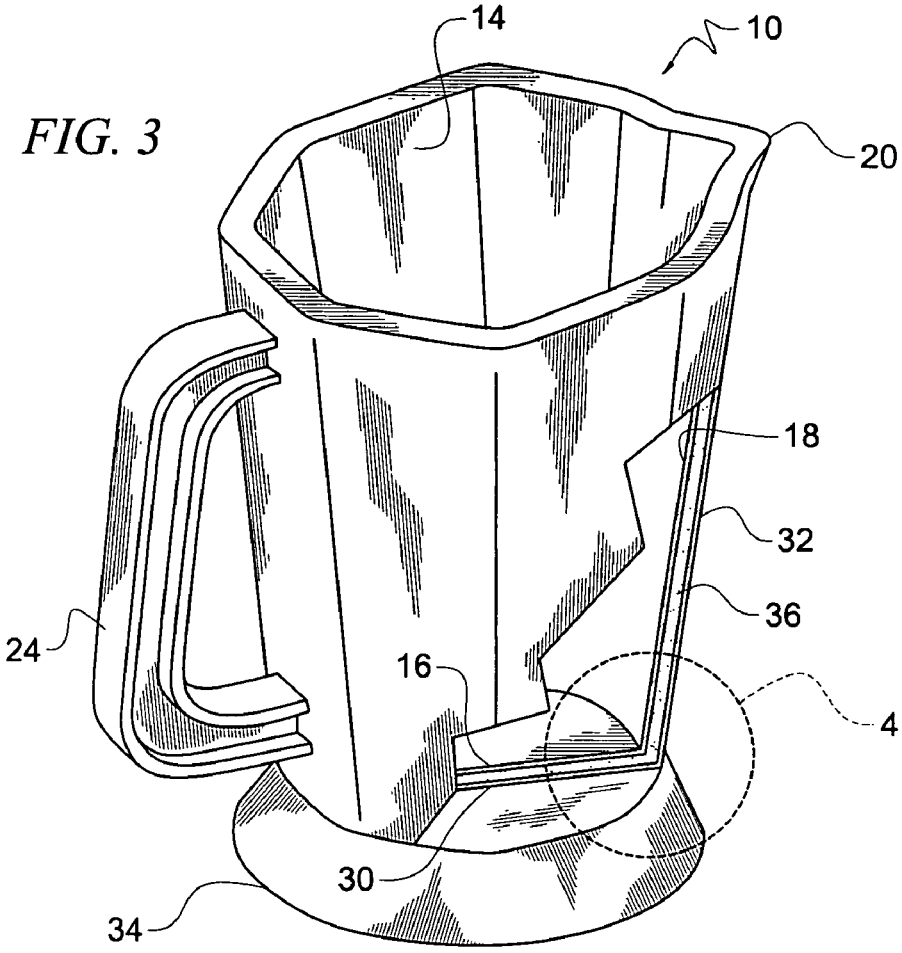
FIG. 3 is a side view, partly broken away and partly in section, of a first embodiment of the invention.
Figure 4:
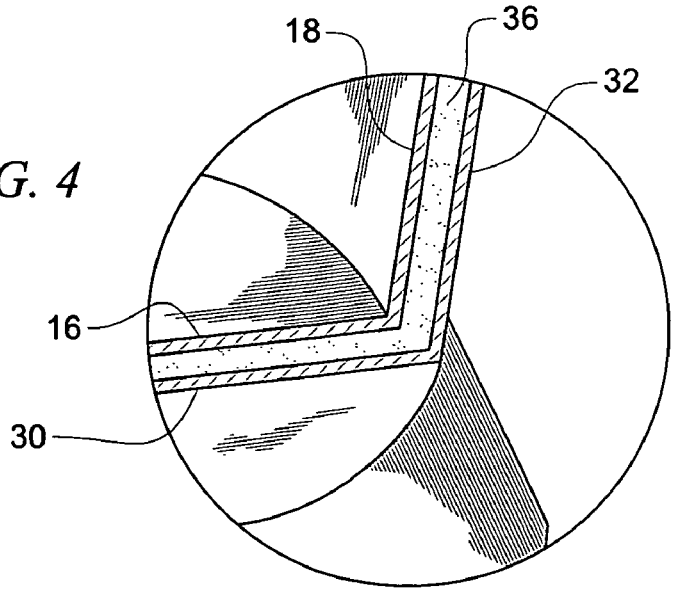
FIG. 4 is fragmentary view showing the extension of the gel through the floor of the pitcher of a first embodiment.

In reference first to FIGS. 1-4, the various features of a first embodiment of the pitcher 10 are shown. As shown in FIGS. 2, 3 and 4, the pitcher 10 is comprised of a pitcher lining 12 inserted into a pitcher shell 26. The pitcher lining 12 has an open top end 14, a bottom wall 16, sidewalls 18 and an annular flanged lip 22. The pitcher shell 26 has an open end defining a rim 28, a bottom wall 30, and sidewalls 32. A handle 24 is integrally affixed to the outer surface of the pitcher shell 26. A base 34 is integrally formed with the bottom wall 30 of the pitcher shell 26, providing stability and support for the pitcher 10.

A pouring spout 20 is structured on the open top end 14 of the pitcher lining 12. The pitcher lining 12 and the pitcher shell 26 are preferably made of plastic.

During the manufacturing of the pitcher 10, the pitcher lining 12 is inserted into the pitcher shell 26, and the flanged lip 22 of the pitcher lining 12 is sealed, preferably by ultrasonic welding, to the rim 28 of the pitcher shell 26, allowing the flanged lip 22 to be permanently mounted onto the rim 28. The sidewalls 32 and bottom wall 30 of the pitcher shell 26, and the sidewalls 18 and bottom wall 16 of the pitcher lining 12, are spaced apart to form a continuous cavity.

Figure 5:
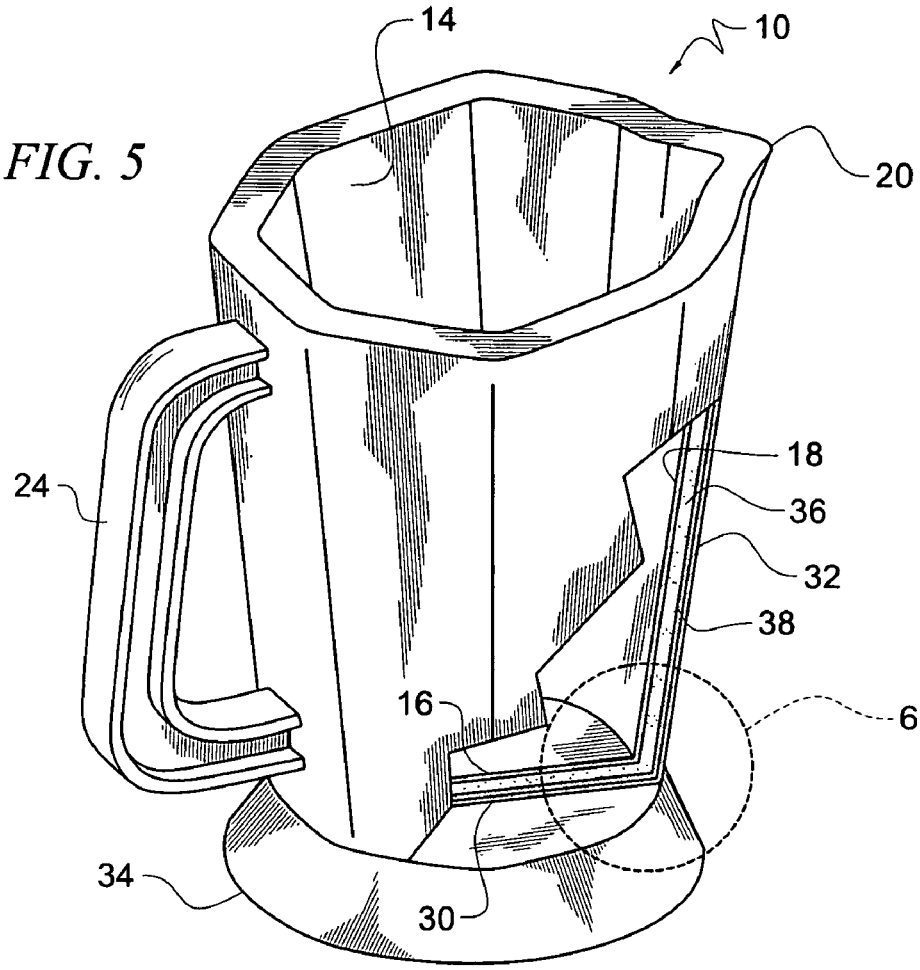
FIG. 5 is a side view, partly broken away and partly in section, of a second embodiment of the invention.
Figure 6:
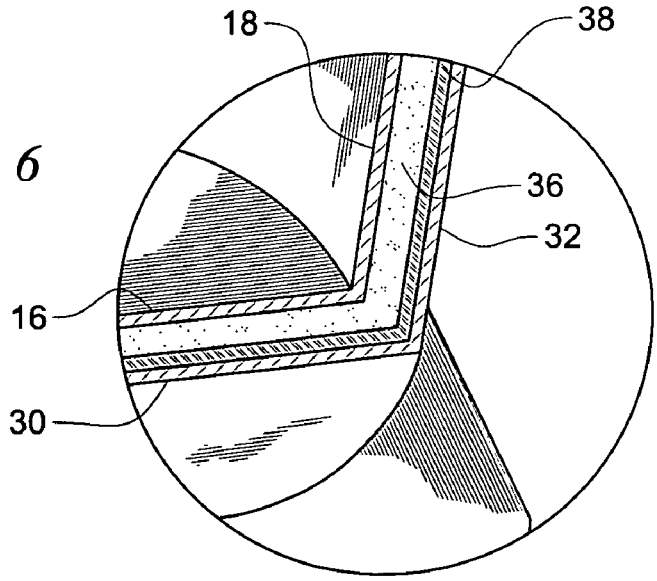
FIG. 6 is a fragmentary view showing the extension of the gel through the floor of the pitcher of a second embodiment.

A freezable substance 36, preferably "blue ice," is permanently disposed within the cavity via an injection process. Other substances are possible as long as the beverage is maintained at a low temperature for extended periods. In a second embodiment of the invention, as illustrated in FIGS. 5 and 6, an insulating layer 38, preferably made of foam, is positioned between the freezable substance 36 and the sidewalls 32 and bottom wall 30 of the pitcher shell 26. The insulating layer 38 retards warming and also reduces condensation.

As shown in FIGS. 4 and 6, a fragmentary view of the pitcher 10 shows that one object of this invention is fulfilled. The freezable substance 36, disposed within the cavity formed continuously between the bottom wall 16 of the pitcher lining 12 and the bottom wall 30 of the pitcher shell 26, provides consistent cooling for the volume of liquid within the inner surface of the pitcher lining 26, and maintains consistent temperature throughout the liquid. No attachments containing crushed ice or freezable gel materials are needed.

With respect to the above description then, it is to be realized that the optimum dimensional relationships for the parts of the invention, to include variations in size, materials, shape, form, function, and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A cooling pitcher comprising the combination of:

a pitcher lining having an open top end, a bottom wall having an inner and outer surface, sidewalls having an inner and outer surface, whereby the inner surface of the sidewalls is disposed between the open top end and the bottom wall defining a volume in which a beverage can be contained;

a pouring spout sutured on the open top end of the pitcher lining;

an annular flanged lip formed on the outer surface of the sidewalls of the pitcher lining near the open top end;

a pitcher shell having an open end defining a rim, a bottom wall having an inner surface, sidewalls having an inner surface and an outer surface, the pitcher shell being configured and dimensioned for insertion of the pitcher lining into the pitcher shell allowing permanent mounting of the flanged lip of the pitcher lining onto the rim, the inner surface of the sidewalls of the pitcher shell and the outer surface of the sidewalls of the pitcher lining being radially spaced apart to form a side cavity, the outer surface of the bottom wall of the pitcher lining and the inner surface of the bottom wall of the pitcher shell being radially spaced apart to form a base cavity, and the side cavity and the base cavity being integrally formed to define a continuous cavity;

a freezable substance being permanently disposed within the continuous cavity;

a handle affixed to the outer surface of the sidewalls of the pitcher shell; and a base integrally formed on the bottom wall of the pitcher shell for support of the pitcher.

2. The cooling pitcher of claim 1, wherein the pitcher lining and the pitcher shell are formed from plastic.

3. A cooling pitcher comprising the combination of:

a pitcher lining having an open top end, a bottom wall having an inner and outer surface, sidewalls having an inner and outer surface, whereby the inner surface of the sidewalls is disposed between the open top end and the bottom wall defining a volume in which a beverage can be contained;

a pouring spout structured on the open top end of the pitcher lining;

an annular flanged lip formed on the outer surface of the sidewalls of the pitcher lining near the open top end;

a pitcher shell having an open end defining a rim, a bottom wall having an inner surface, sidewalls having an inner surface and an outer surface, the pitcher shell being configured and dimensioned for insertion of the pitcher lining into the pitcher shell allowing permanent mounting of the flanged lip of the pitcher lining onto the rim, the inner surface of the sidewalls of the pitcher shell and the outer surface of the sidewalls of the pitcher lining being radially spaced apart to form a side cavity, the outer surface of the bottom wall of the pitcher lining and the inner surface of the bottom wall of the pitcher shell being radially spaced apart to form a base cavity, and the side cavity and the base cavity being integrally formed to define a continuous cavity;

a freezable substance being permanently disposed within the continuous cavity;

a handle affixed to the outer surface of the sidewalls of the pitcher shell;

a base integrally formed on the bottom wall of the pitcher shell for support of the pitcher; and an insulating layer extending through the continuous cavity of the pitcher juxtaposed between the freezable substance and the inner surface of the sidewalls and the bottom wall of the pitcher shell.

4. The cooling pitcher of claim 3, wherein the pitcher lining and the pitcher shell are formed from plastic.

5. The cooling pitcher of claim 3, wherein the insulating layer is formed from foam.

* * * * *

UNITED STATES PATENT AND TRADEMARK OFFICE

CERTIFICATE OF CORRECTION

PATENT NO. : 7,484,383 B1
APPLICATION NO. : 11/378692
DATED : February 3, 2009
INVENTOR(S) : James Turner It is certified that error appears in the above-identified patent and that said Letters Patent is hereby corrected as shown below:

Column 3, line 37, "sutured" should read "structured".

Signed and Sealed this

Fourth Day of May, 2010

David J. Kappos

David J. Kappos
*Director of the United States Patent and Trademark Office*